US007789708B2

(12) United States Patent
Laurx et al.

(10) Patent No.: US 7,789,708 B2
(45) Date of Patent: Sep. 7, 2010

(54) CONNECTOR WITH BIFURCATED CONTACT ARMS

(75) Inventors: John Laurx, Aurora, IL (US); Kent Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 28 days.

(21) Appl. No.: 12/214,611

(22) Filed: Jun. 20, 2008

(65) Prior Publication Data

US 2009/0011664 A1 Jan. 8, 2009

Related U.S. Application Data

(60) Provisional application No. 60/936,387, filed on Jun. 20, 2007.

(51) Int. Cl.
*H01R 13/648* (2006.01)

(52) U.S. Cl. ..... 439/608

(58) Field of Classification Search ..... 439/608, 439/108, 701, 856, 862, 861, 867, 872, 882, 439/884

See application file for complete search history.

(56) References Cited

U.S. PATENT DOCUMENTS 4,607,907 A * 8/1986 Bogursky ..... 439/682
4,733,172 A 3/1988 Smolley
4,973,273 A * 11/1990 DePriest ..... 439/856
5,019,945 A 5/1991 Smolley
5,417,596 A * 5/1995 Kusakabe ..... 439/857
5,672,084 A * 9/1997 Feldman ..... 439/852
5,795,191 A 8/1998 Preputnick et al.
6,116,926 A * 9/2000 Ortega et al. ..... 439/108
6,146,202 A 11/2000 Ramey et al.
6,146,207 A 11/2000 Mulot
6,224,432 B1 * 5/2001 Billman ..... 439/856
6,328,602 B1 12/2001 Yamasaki et al.
6,350,134 B1 2/2002 Fogg et al.
6,379,188 B1 4/2002 Cohen et al.
6,471,548 B2 10/2002 Bertoncini et al.
6,540,559 B1 4/2003 Kemmick et al.
6,652,318 B1 11/2003 Winings et al.
6,692,272 B2 2/2004 Lemke et al.

(Continued)

FOREIGN PATENT DOCUMENTS

EP 0924812 6/1999

(Continued)

OTHER PUBLICATIONS

International Search Report for PCT/US2008/007753.

*Primary Examiner*—Alexander Gilman
(74) *Attorney, Agent, or Firm*—Stephen L. Sheldon

(57) ABSTRACT

A backplane electrical connector electrically and physically connects a daughter card printed circuit board to a backplane printed circuit board. The electrical connect can be of a two-piece construction including a daughtercard connector mateable with a pin header. The daughtercard connector can be assembled from a plurality of wafers which each can include a plurality of conductive leads. The wafers can have an attachment edge that lies adjacent to the daughtercard and a mating edge that is directed toward the pin header. Each conductive lead can include a bifurcated contact extending from the mating edge and each can have a first arm and a second arm. The first and second arms can provide two redundant points of contact with a corresponding conductive pin disposed in the pin header.

15 Claims, 8 Drawing Sheets

U.S. PATENT DOCUMENTS

| | | | | |
|---|---|---|---|---|
| 6,743,057 | B2 | 6/2004 | Davis et al. | |
| 6,808,419 | B1 | 10/2004 | Korsunsky et al. | |
| 6,827,611 | B1 * | 12/2004 | Payne et al. | 439/608 |
| 6,843,687 | B2 | 1/2005 | McGowan et al. | |
| 6,863,543 | B2 | 3/2005 | Lang et al. | |
| 7,131,870 | B2 | 11/2006 | Whiteman et al. | |
| 7,163,421 | B1 | 1/2007 | Cohen et al. | |
| 7,195,497 | B2 | 3/2007 | Hull et al. | |
| 7,267,515 | B2 | 9/2007 | Lappohn | |
| 7,332,856 | B2 | 2/2008 | Kijima et al. | |
| 7,338,321 | B2 | 3/2008 | Laurx | |
| 7,384,311 | B2 | 6/2008 | Sharf et al. | |
| 7,458,839 | B2 | 12/2008 | Ngo et al. | |
| 7,473,138 | B2 | 1/2009 | Tuin et al. | |
| 7,553,190 | B2 | 6/2009 | Laurx et al. | |
| 7,591,655 | B2 | 9/2009 | Fedder et al. | |
| 2001/0010979 | A1 | 8/2001 | Ortega et al. | |
| 2003/0171010 | A1 | 9/2003 | Winings et al. | |
| 2004/0043648 | A1 | 3/2004 | Houtz | |
| 2004/0097112 | A1 | 5/2004 | Minich et al. | |
| 2006/0172570 | A1 | 8/2006 | Minich | |
| 2007/0021001 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0049118 | A1 | 3/2007 | Reeser et al. | |
| 2007/0059952 | A1 | 3/2007 | Raistrick et al. | |
| 2009/0011642 | A1 | 1/2009 | Amleshi et al. | |
| 2009/0011643 | A1 | 1/2009 | Amleshi et al. | |
| 2009/0011644 | A1 | 1/2009 | Amleshi et al. | |
| 2009/0011645 | A1 | 1/2009 | Laurx et al. | |
| 2009/0011655 | A1 | 1/2009 | Amleshi et al. | |
| 2009/0017681 | A1 | 1/2009 | Amleshi et al. | |
| 2009/0017682 | A1 | 1/2009 | Amleshi et al. | |
| 2009/0071682 | A1 | 3/2009 | Crawford | |

FOREIGN PATENT DOCUMENTS

| | | | |
|---|---|---|---|
| EP | 1732176 | | 12/2006 |
| WO | 86/01644 | A1 | 3/1986 |
| WO | 01/57964 | | 8/2001 |
| WO | 2007/058756 | | 5/2007 |
| WO | 2007/076900 | | 7/2007 |
| WO | 2008/002376 | | 1/2008 |
| WO | 2008/156856 | | 12/2008 |

* cited by examiner

CONNECTOR WITH BIFURCATED CONTACT ARMS

REFERENCE TO RELATED APPLICATIONS

This application claims the domestic benefit of U.S. Provisional Application Ser. No. 60/936,387, filed on Jun. 20, 2007, which disclosure is hereby incorporated by reference.

BACKGROUND OF THE INVENTION

The present invention relates generally to back plane connectors, and more particularly, to a daughtercard connector having terminals adapted for improved, more reliable transmission of high speed differential signals.

Routers, servers and similar electronic communication and processing devices typically include multiple printed circuit boards (PCBs) arranged and operatively connected together. For example, a backplane board can be provided to which one or more daughter cards are connected. In order to conserve space and promote air cooling over the backplane and daughtercards, the daughtercards can be arranged parallel to each other and at a right angle to the backplane. Electrically connecting the backplane and daughtercards together can be accomplished by backplane connectors.

Backplane connectors can be of a two-piece construction and typically comprise a pin header which is mountable on the backplane and the daughtercard connector mounted on a daughtercard. The daughtercard connector is detachably mateable with the pin header to facilitate assembly and disassembly of the electronic device. In various embodiments, to enable the backplane PCB and the daughtercard PCB to be connected together at right angles, the daughtercard connector can include a plurality of conductive leads that bend or extend through a 90° angle so that the contact ends of the leads are arranged perpendicularly to one another. As will be appreciated by those of skill in the art, the conductive leads can be configured to transmit single-ended signals or, in order to facilitate high speed data transmission, the conductive leads within the backplane connector can be configured to carry differential signals. Moreover, the leads can include a contact end that physically projects from the daughtercard connector and can physically contact pins secured in the pin header and thereby complete electrical communication between the daughtercard connector and the pin header.

To ensure good electrical contact between the daughtercard leads and the pins, it is known to form the contact end of the leads as bifurcated contacts. Bifurcated contacts may include two spaced-apart, bifurcated arms, each of which can establish a separate contact point with the conductive pin. An advantage of establishing two points of contact between the bifurcated contact and the pin is to facilitate redundant and reliable electrical connection with the pins in the header. As can be appreciated though, the bifurcated arms of the leads can interfere with placement of adjacent contacts, can require offsetting or uneven contact positioning, and can increase insertion forces during mating of the connector with a pin header. They also can be complicated in design and relatively costly to manufacture.

SUMMARY OF THE INVENTION

It is therefore a general object of the present invention to provide a backplane-daughterboard connector which is adapted for more reliable interfacing with a backplane connector for high speed electrical signal transmission.

Another object is to provide a connector as characterized above which has bifurcated contacts which lend themselves to more reliable electrical connection with the pin contacts of a pin header.

A further object is to provide a connector of the foregoing type in which the bifurcated contacts have a streamlined design which permits uniform contacts spacing.

Still another object is to provide a connector of the above kind in which the bifurcated contacts are relatively simple in design and lend themselves to economical manufacture.

In accordance with the foregoing objects of the invention, there is described herein a backplane connector including a daughtercard connector mateable with a pin header. The daughtercard connector can be assembled from a plurality of wafers arranged in a side-by-side relation. Disposed in each wafer can be a plurality of conductive leads for transmitting signals between the backplane PCB and daughtercard PCB. Each wafer can include a mating edge which can be oriented toward the pin header during mating. To electrically contact the pins of the pin header, each conductive lead can include a bifurcated contact extending from the mating edge. The bifurcated contacts can each include a first arm and a second parallel and co-planar arm that is spaced apart from the first arm. The first arm can extend a greater length from the body of the connector than the second arm. In various embodiments, the first arm can be generally straight and the second arm can be "L" shaped having formed at its distal end a first leg extending transversely across the distal end of the first arm.

In other embodiments, the longer second arm can be "J" shaped and can hook back upon itself so that the distal end of the second arm is linearly aligned with the first arm. The second arm can have a width generally approximate the width of the first arm but less than the combined width of the first and second arms. When the daughter card connector is mated with the pin header, the longer second arm initially will come into sliding contact with a corresponding pin, then the straight, shorter second arm will come into sliding contact with the corresponding pin. Accordingly, the bifurcated contact provides two redundant points of contact with the pin. An advantage of providing two redundant points of contact is to accommodate misalignment or physical distortion among the bifurcated contacts and the pins.

In another aspect of the invention, there can be formed on the respective distal ends of the first and second arms of the bifurcated contact a corresponding first contact protuberance and a second contact protuberance. With respect to the second arm, the contact protuberance can be formed on the either the "L" or "J" shaped distal portion that is offset with respect to the main linear portion of the second arm. Because the "L" or "J" shaped distal portion of the second arm extends transversely with respect to the first arm, the contact protuberances can be aligned along an imaginary line delineated along the direction of extension of the first straight arm extending from the mating face. In a further aspect of the invention, the contact protuberances within a wafer can all be oriented in the same direction. An advantage of orienting the protuberances in one direction is to enable close packing of the bifurcated contacts extending from the mating edge.

In various other aspects, the invention can provide a daughtercard connector and/or a lead frame having bifurcated contacts as described herein. These and other objects, features and advantages of the present invention will be clearly understood through a consideration of the following detailed description.

BRIEF DESCRIPTION OF THE DRAWINGS

In the course of this detailed description, reference will be frequently made to the attached drawings in which.

DETAILED DESCRIPTION OF THE PREFERRED EMBODIMENTS

Figure 1:
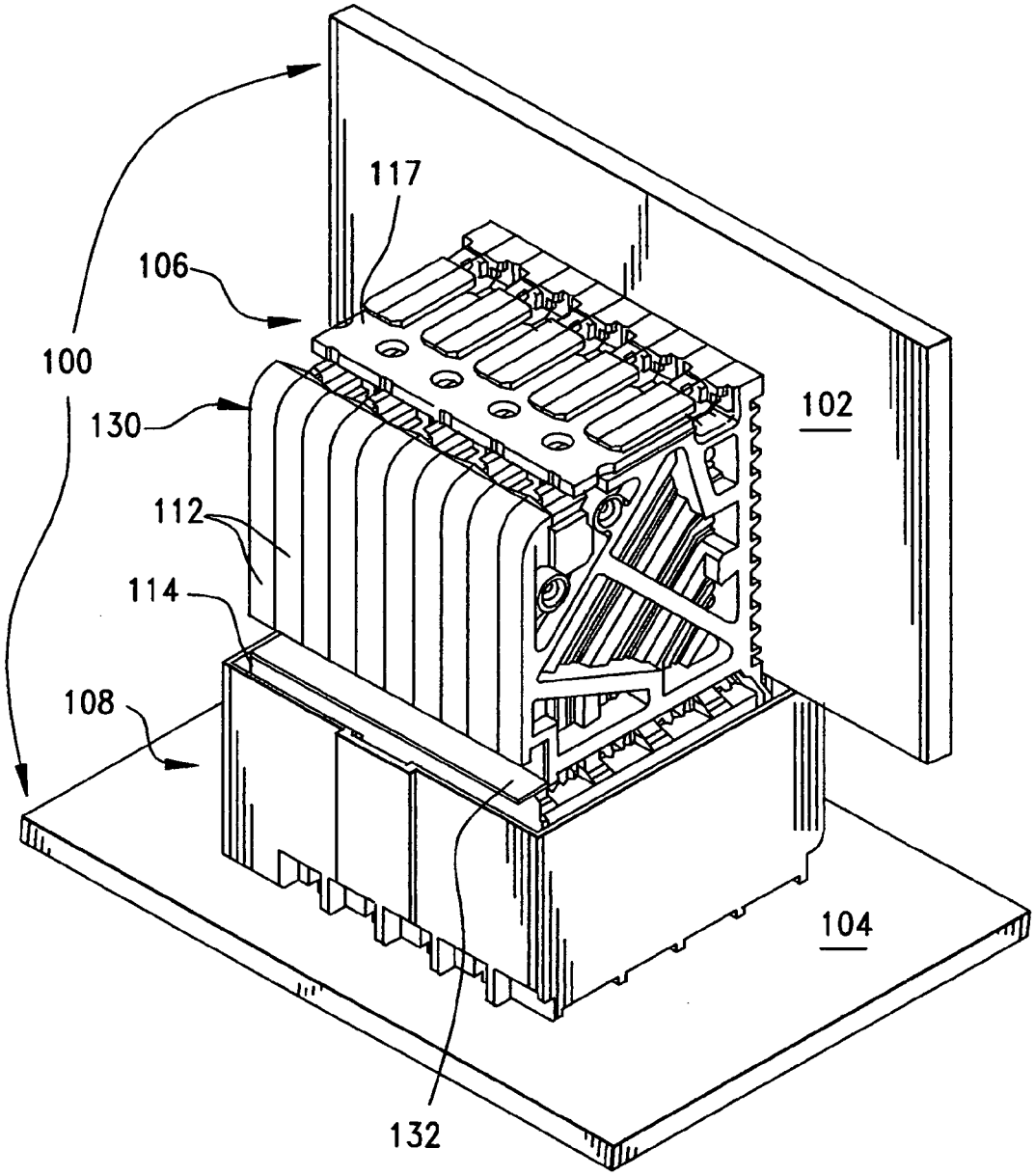
FIG. 1 is a perspective view of a backplane electrically connected at a right angle to a daughtercard with a two-part backplane connector that includes a pin header and a daughtercard connector mated together.

Referring now to FIG. 1, there is shown an illustrated backplane connector 100 used to electrically and/or physical connect together a backplane printed circuit board 104 ("PCB") and a daughtercard PCB 102. The backplane connector can be of a two-piece construction and includes a backplane pin header 108 mounted to the backplane PCB and a daughtercard connector 106 mounted to the daughtercard 102. In order to facilitate assembly and disassembly of the backplane PCB and daughtercard PCB, the daughtercard connector and the pin header can be detachably pluggable or mateable together. In the illustrated embodiment, because the backplane PCB 104 and the daughtercard PCB 102 are arranged at a right angle to each other, the backplane connector 100 is a right angle connector and the electrical paths through connector 100 accordingly transition or change direction through a 90° bend. However, in other embodiments, the backplane PCB 104 and daughtercard PCB 102 can be arranged at other angles with respect to each other or even be parallel and opposed to each other such as in a vertically stacked, mezzanine style connector and the electrical paths can be arranged accordingly.

Figure 2:
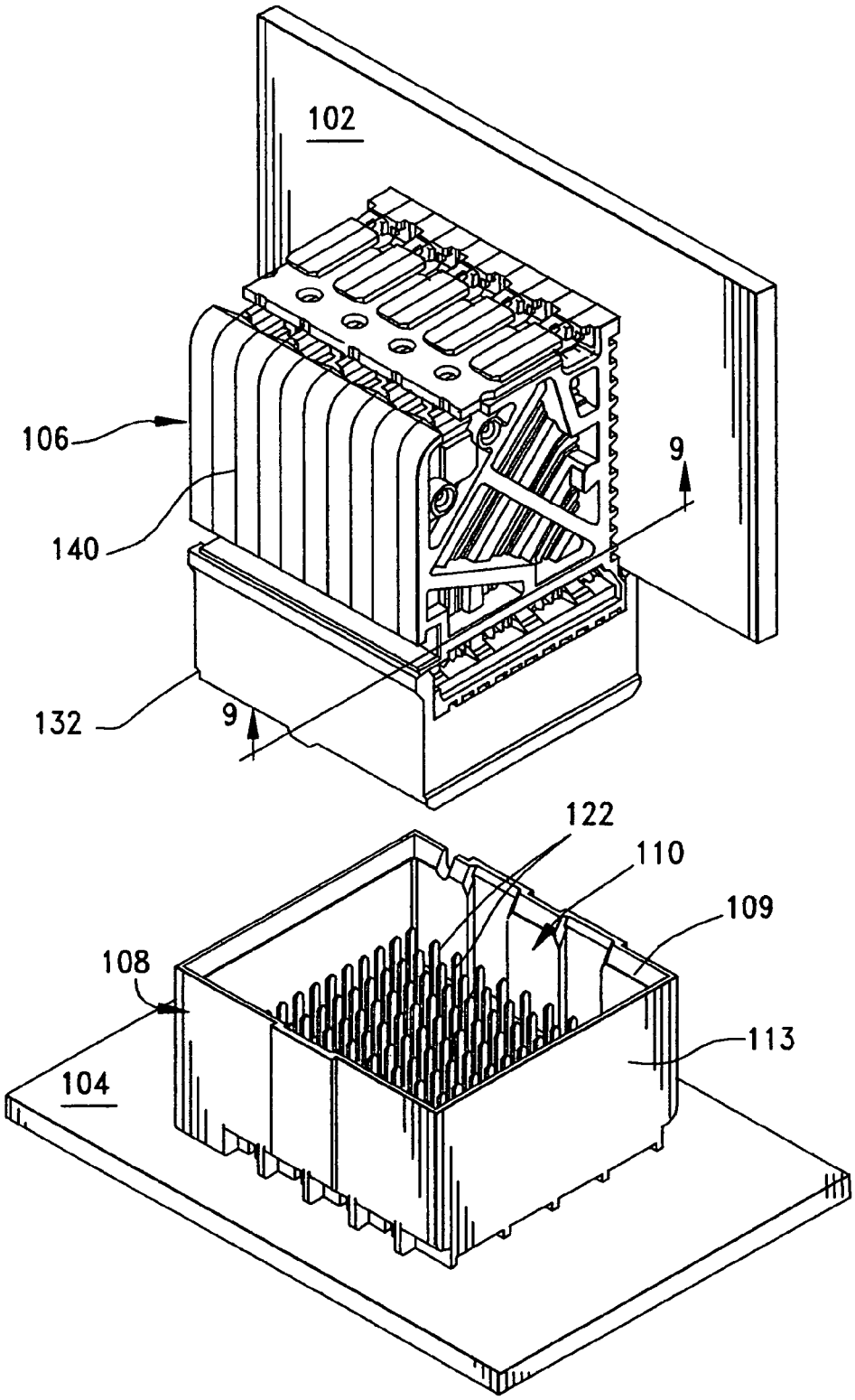
FIG. 2 is a top perspective view of a pin header part of FIG. 1 with the pin header detached from the daughtercard connector and including a plurality of pins retained therein.

Referring to FIG. 2, there is illustrated a backplane pin header 108 as detached from the daughtercard connector 106. The backplane pin header 108 includes a housing 109 made of an insulative material such as molded thermoplastic and a plurality of conductive contact pins 122 retained therein in a central open area 110. The housing 120 demarcates an attachment face 124 that lies adjacent to the backplane PCB 104 when the backplane pin header 110 is mounted thereto. As can be appreciated, the conductive, flat, blade-like pins 122 extend through the attachment face 124 to be in electrical contact with conductive traces on the backplane PCB 104. Moreover, the plurality of pins 122 can be arranged and aligned in columns and rows. The housing 109 can include an upward extending, four-sided peripheral wall 113 that generally surrounds and protects the projecting pins 122.

Figure 3:
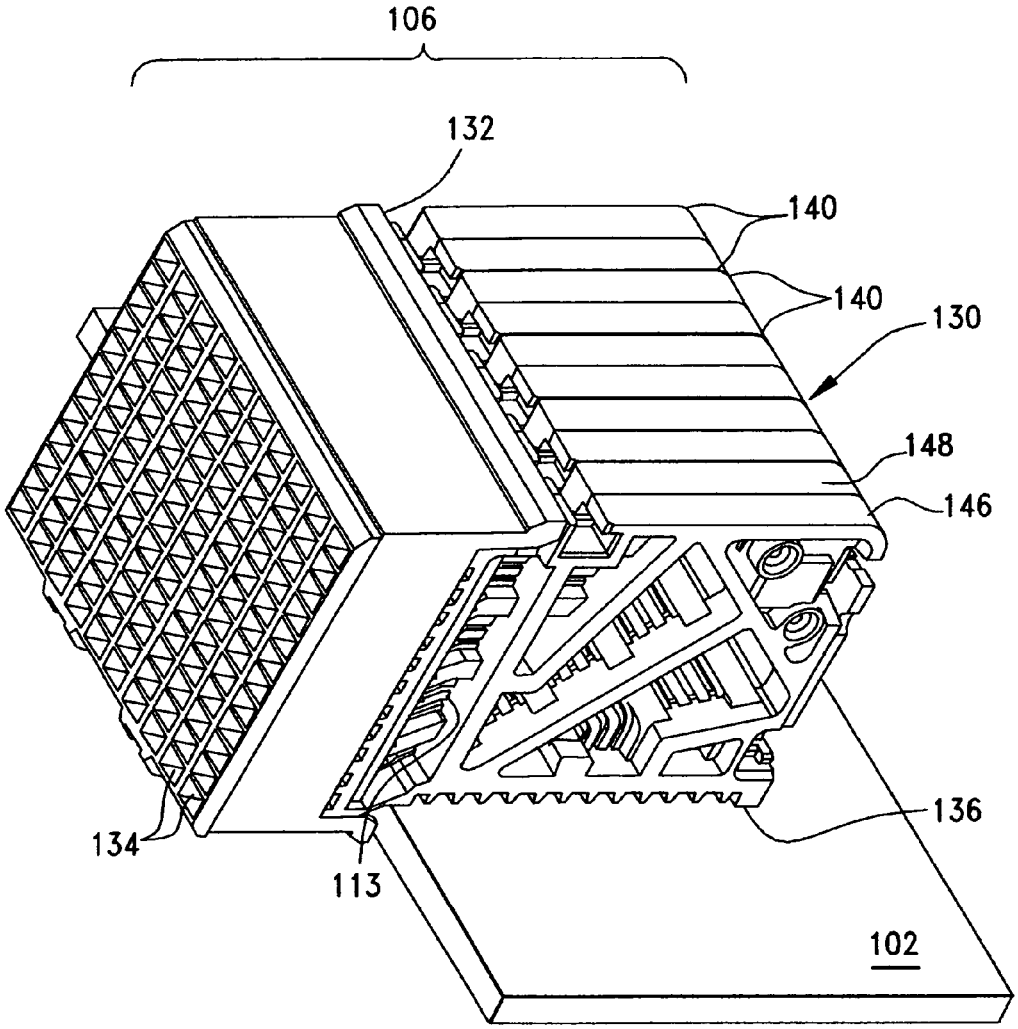
FIG. 3 is a perspective view of the daughtercard connector part of FIG. 1 with the daughtercard connector detached from the pin header.

Referring to FIGS. 1 and 3, the daughtercard connector 106 can be of a multi-component construction and includes a wafer block 130 (which includes a plurality of individual connector wafers 140) and a front housing 132 attached to the wafer block. When plugged to the backplane pin header, the front housing 132 can be inserted into the inner area 110 outlined by the peripheral wall 113. In order to receive the plurality of projecting pins 122 of the backplane pin header 108, the front housing 132 further includes a plurality of cavities 134 (FIG. 3) correspondingly arranged in columns and rows.

The wafer block 130 can include an attachment face 136 that is adjacent to the daughtercard PCB 102 when the daughtercard connector 112 is mounted thereon. In addition to the attachment face 136, the wafer block 130 can also include a mating face 138 that is directed toward and adjacent to the front housing 132. Because the illustrated embodiment is configured as a right angle connector, the mating face 138 is oriented perpendicular to the attachment face 136. However, in other embodiments, the mating face 138 and the attachment face 136 can be arranged at other angles with respect to each other.

As will be appreciated by those of skill in the art, the wafer block 130 can be assembled from a plurality of connector wafers 140 arranged in a side-by-side configuration. The wafers 140 can be arranged generally perpendicular to the front housing 132. To retain the wafers 140 to each other in the side-by-side relation, as illustrated in FIG. 1, a metal stiffener strip 139 can extend across the rear of the daughtercard connector 112.

Figure 4:
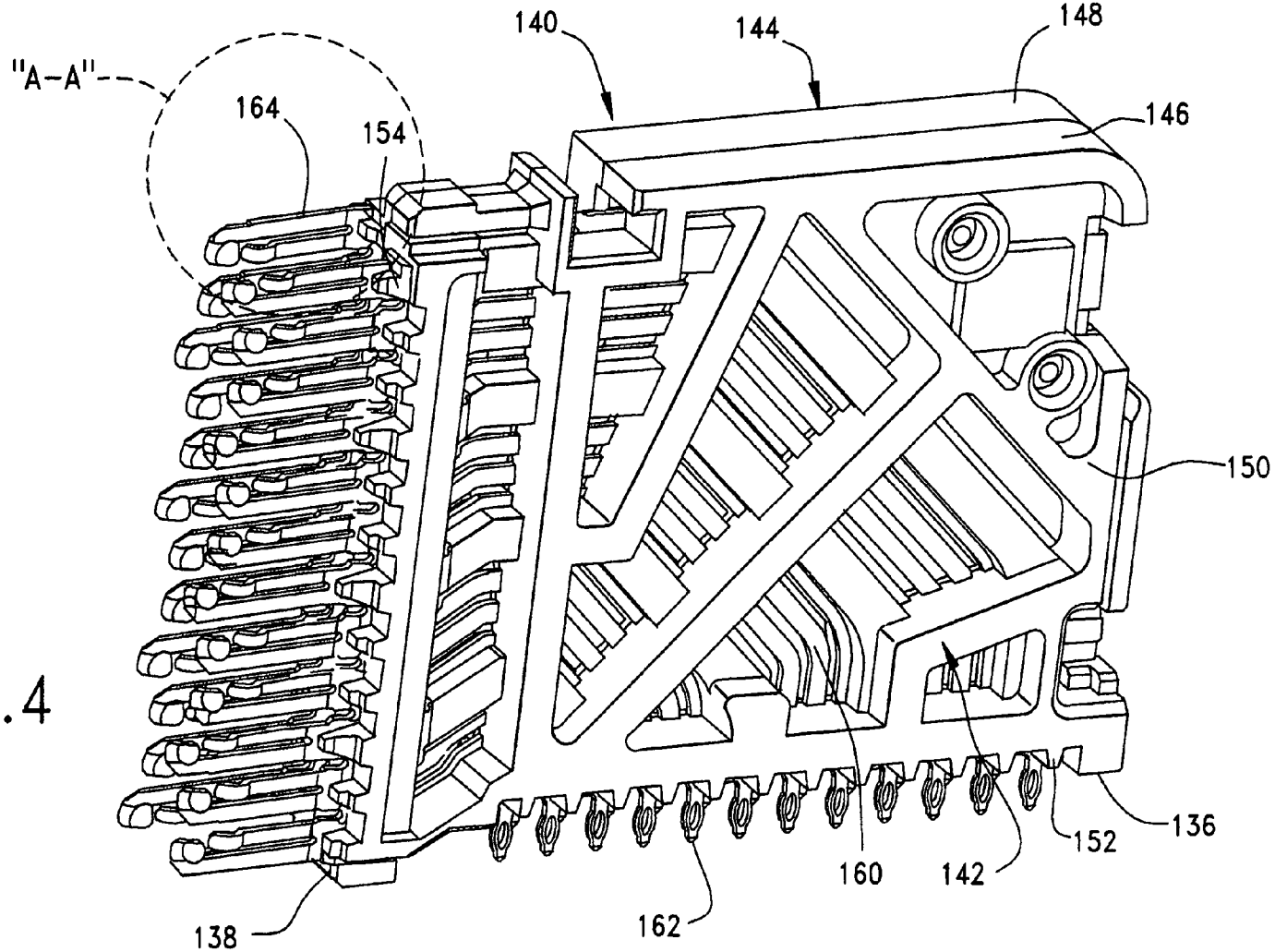
FIG. 4 is a perspective view of a wafer forming part of the daughtercard connector, the wafer including a plurality of conductive leads having bifurcated contact ends constructed in accordance with the principles of the present invention.

As best illustrated in FIG. 4, each connector wafer 140 is generally square in shape and can include a first major side 142 and an opposing second major side 144. The wafer 140 itself can be assembled from a first wafer half or waflet 146 and an opposing second wafer half or waflet 148 that are placed together. Each of the first and second waflets 146, 148 are associated with a corresponding one of the respective first and second major sides 142, 144. The waflets 146, 148 are constructed of an insulative support frame 150, such as a molded thermoplastic material, disposed about a plurality of conductive contact leads or terminals 160. The support frame 150 has a generally square shape including a first attachment edge 152 that corresponds to the attachment face 136 of the wafer block 130 and a second mating edge 154 that corresponds to the mating face 138 of the wafer block 130. Accordingly, in the right angled embodiment of the connector 100, the first attachment edge 152 and the second mating edge 154 are orthogonal to each other.

The plurality of conductive leads 160 are arranged on an inside surface of each waflet to extend between the first edge 152 and the second edge 154 and thereby provide electrical paths across the daughtercard connector. In order to establish electrical contact with the backplane pin header, there is formed at the first end of each contact lead 160 a compliant terminal 162 that projects beyond the attachment edge 152. In order to contact the contact pins 122 of the pin header, the second end of each contact lead 160 is formed as a bifurcated contact 164 which extends beyond and perpendicular to the mating edge 154 of the wafer 140. On the inner side of each waflet 146, 148, the conductive leads 160 are co-planar and are arranged adjacently so as to extend generally parallel to one another. Accordingly, along the mating edge 154 of the wafer 140, the conductive leads 160, and particularly, the bifurcated contacts 164 are arranged as a generally vertical column. Because each waflet 146, 148 includes a plurality of adjacent contact leads 160, two columns of bifurcated contacts 164 are formed within each wafer 140.

Figure 5:
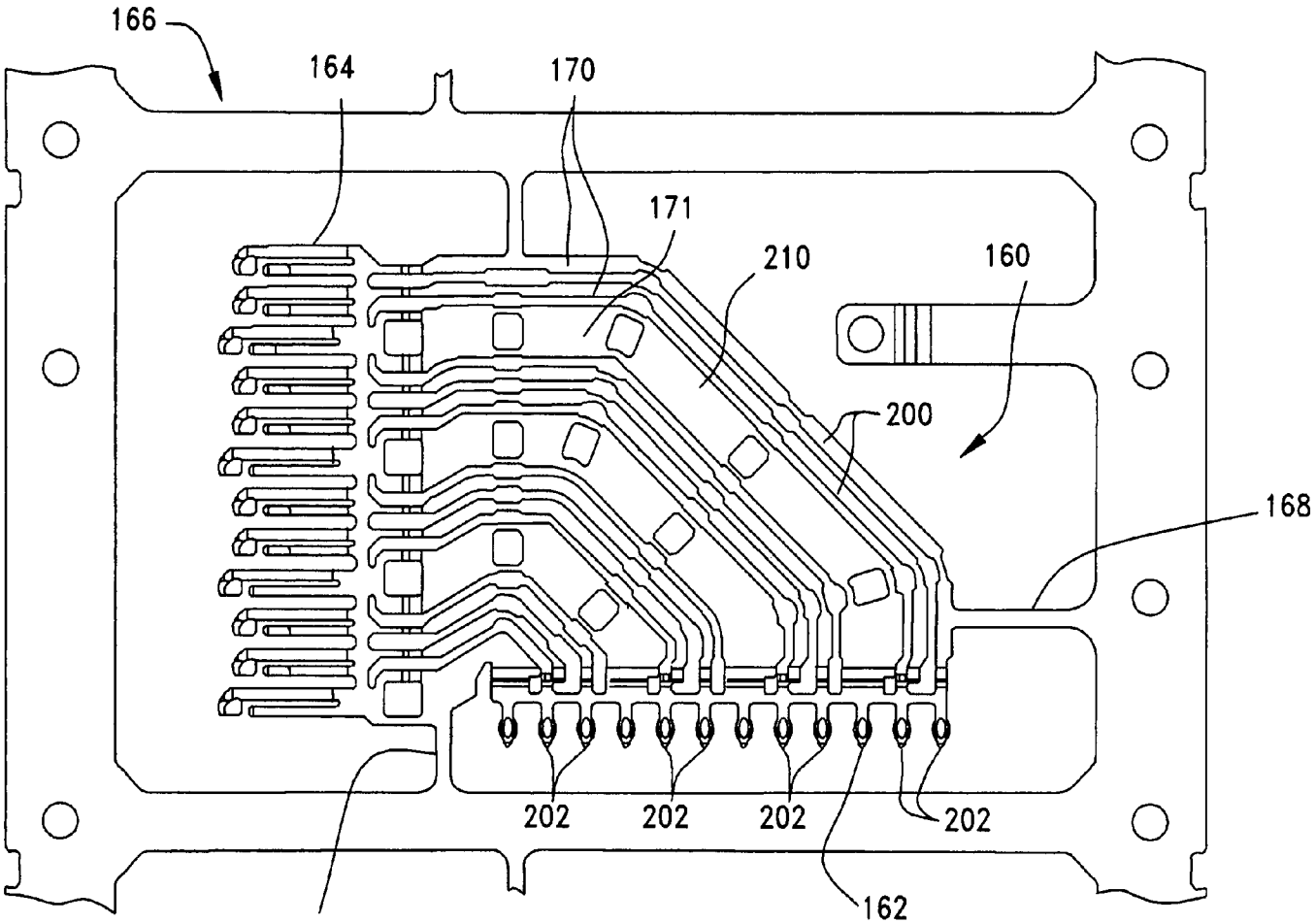
FIG. 5 is top plan view of a stamped and formed lead frame including the conductive leads.

Referring to FIG. 5, there is illustrated a stamped lead frame 166 that forms the plurality of contacts leads 160. The lead frame 166 can be stamped from a thin, planar sheet of conductive material such as copper. Accordingly, all the conductive leads 160 in the lead frame 166 are co-planar with one another. The individual leads in the lead frame 166 are joined together by one or more tie bars 168 which can be snapped or broken to conductively separate the leads after the insulative support frame is molded about the lead frame. To conductively connect the bifurcated contacts 164 and the compliant pins 162, each lead 160 includes an elongated, flat conductive portion 170. As can be appreciated, the shape and orientation of the conductive portion 170 assists in providing the right angle arrangement of the electrical connector. The illustrated embodiment of the lead frame includes twelve individual leads, however, in other embodiments there can be any other suitable number of leads.

Figure 6:
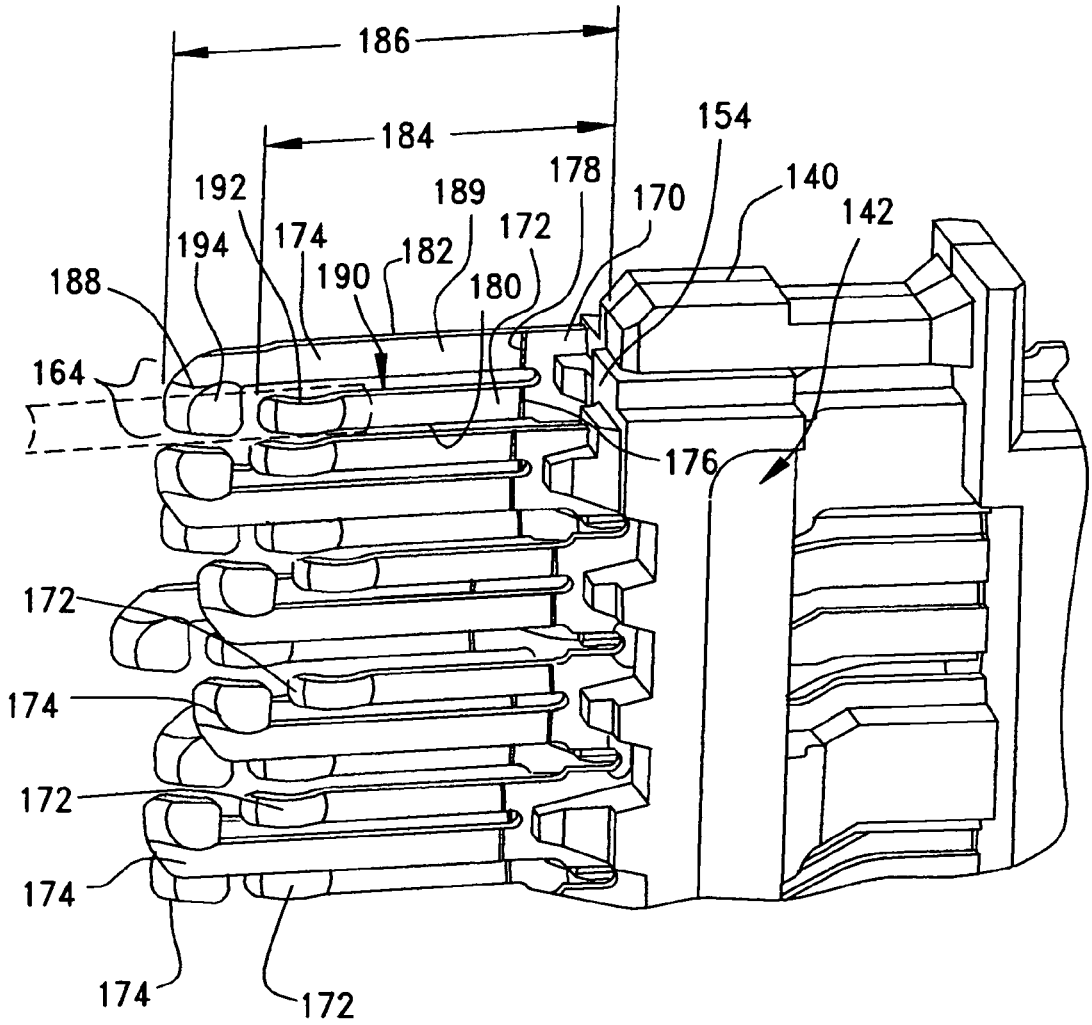
FIG. 6 is a detailed view of the area indicated by circle A-A of FIG. 4, illustrating the bifurcated contacts extending from a wafer.

In accordance with an aspect of the invention, there is illustrated in FIG. 6, an enlarged detail view of the mating face 154 of the daughtercard connector 106. As shown, a pair of bifurcated contacts 164 extend in a direction perpendicular from the mating face 154 of the wafer 140. Each such bifurcated contact 164 includes a first arm 172 and a parallel, spaced-apart second arm 174. The first and second arms 172, 174 are commonly joined to and extend from a front conductive portion 170 of the lead 160. To configure the first and second arms 172, 174 in a cantilevered relation with respect to the conductive portion 170 and with respect to each other, the first and second arms are joined to the conductive portion by respective first and second, distinct flexural points or lines 176, 178. As should be appreciated, the flexure of the contact arms may not occur specifically at a point or line but may occur gradually over the length of the arm. For sake of representation, though, the points of flexure are represented by lines 176, 178. Because the arms 172, 174 are parallel with each other, it can be appreciated that the arms of each bifurcated contact 164 within a waflet are all co-planar in an imaginary vertical plane extending along the column of bifurcated contacts and extending normally from the mating edge 154.

In the illustrated embodiment, the first arm 172 extends from the mating face 154, a first distance designated 184 and the second arm 174 extends a second distance designated 186 which is longer than the first distance. Accordingly, while the first and second arms 172, 174 are co-planar, the first arm 172 is shorter in length than the second arm 174. Additionally, the first arm 172 can be positioned vertically below the second arm 174. Accordingly, the first arm 172 can delineate a lower edge 180 of the bifurcated contact 164 and the second arm 174 can delineate an upper edge 182, wherein the lower and upper edges define the width of the bifurcated contact 164.

To contact a corresponding pin in the pin header, each arm 172, 174 can include a raised contact protuberance 192, 194 that projects out of the plane provided by the co-planar bifurcated contacts 164 forming the vertical column of contacts. The contact protuberances 192, 194 can be formed by a suitable stamping operation preformed during manufacture of the lead frame. In particular, the raised contact protuberance 192 on the first arm 172 is formed at its distal end and the raised contact protuberance 194 on the second arm 174 is formed proximate its distal end. Because the second arm is longer than the first arm 172, the second raised protuberance is located further from the mating edge 154 of the wafer than the first raised protuberance 194. Therefore, as described below, in the illustrated embodiment the second raised protuberance 194 will come into contact with a corresponding pin before the first raised protuberance.

In the illustrated embodiment, the shorter, first arm 172 can be linear or straight while the longer, second arm 174 can have a "L"-shaped outline. To provide the "L" shape to the second arm 174, the second arm includes a leg portion 188 that extends transversely from the distal end of the main linear extension 189 of the second arm. Preferably, the leg 188 extends generally from the upper edge 182 to proximate the lower edge 180 of the bifurcated contact. The leg portion 188 therefore traverses across the distal end of the first, shorter arm 172 and is spaced apart therefrom by a gap 193. Further, the leg portion 188 is preferably parallel to the mating edge 154 of the wafer 140. Accordingly, the "J" shaped second arm generally outlines a recess 190 in which the shorter contact arm 172 can be provided. The "J" shaped second arm 174 therefore encompasses or envelops the shorter, straight first arm 172.

In the illustrated embodiment, the second contact protuberance 194 can be formed on the transverse leg portion 188 of the "L" shaped second arm 174. Because the leg portion 188 of the "L" shaped second arm is linearly aligned with the first arm 172, the contact protuberances 192, 194 of both the first and second arms are linearly aligned along the linear direction of extension of the first arm 172 from the mating face 154. Additionally, the plurality of leads 160 can be disposed in the wafer 140 so that the raised contact protuberances 192, 194 of each bifurcated contact 164 are uniformly directed toward the first major side 142 of the wafer. Aligning and directing the raised contact protuberances together enables closer, denser packing of the bifurcated contacts along the mating edge of a wafer and of adjacent columns of bifurcated contacts of multiple wafers.

Figure 7:
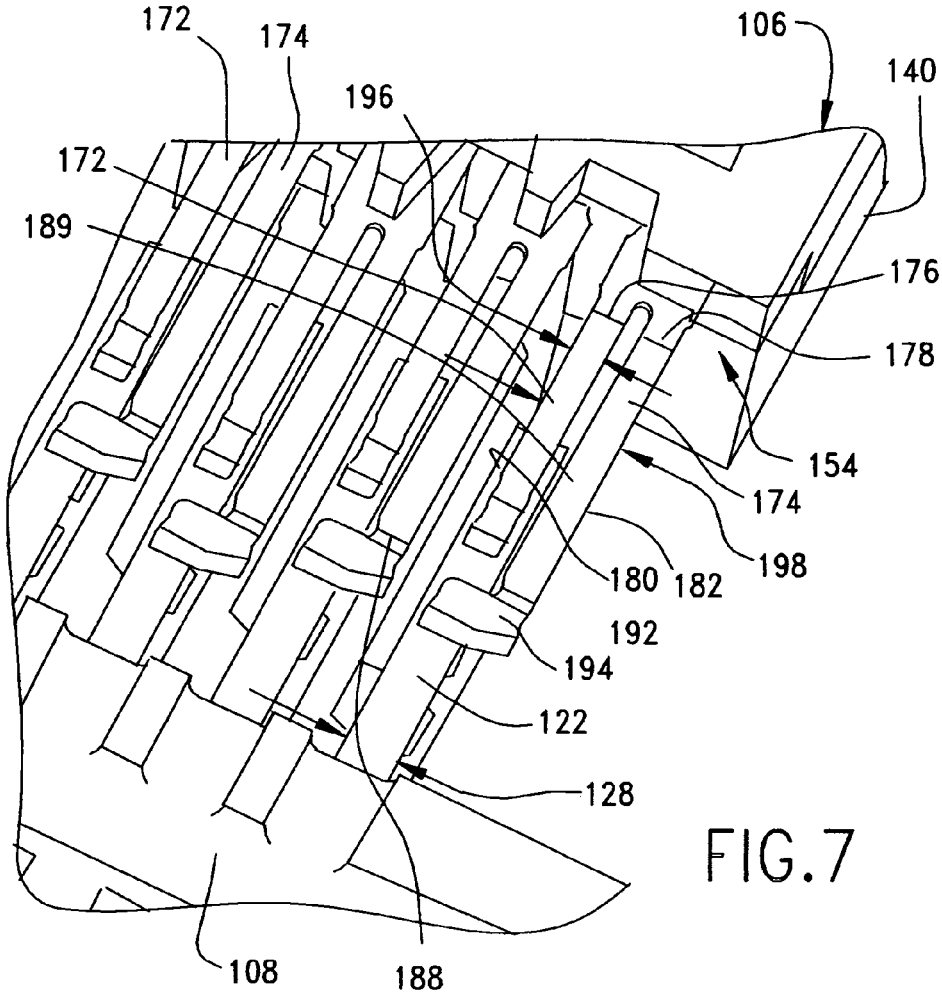
FIG. 7 is a detailed view showing the electrical contact made between the contact pins retained in the pin header and the bifurcated contact end extending from the daughtercard connector where the connectors of FIG. 1 are mated together.

Referring to FIG. 7, there is illustrated the interaction between the bifurcated contacts 164 and the pins 122 of the pin header 120. As can be appreciated, as a wafer 140 of the daughtercard connector 106 is moved into pluggable engagement with the pin header 108, the extended bifurcated contacts 164 align with corresponding pins 122 due to sliding engagement of the front housing and the peripheral wall. In particular, the contact pin 122 of the header 108 preferably has a width 128 corresponding generally to at least the width 196 of the straight arm 172 but narrower than the width 198 defined between the lower and upper edges 180, 182 of the bifurcated contact. Most preferably, the width of the pin 122 will be slightly larger than the width of the straight contact arm 172. During mating, the pin 122 aligns with the linear direction of the second straight arm 172. Accordingly, the pin 122 is parallel but offset with respect to the main linear extension 189 of the second "L" shaped arm 174 but partially aligned with the traverse leg. The raised contact protuberance 194 on the longer "L" shaped second arm 174 will initially come into sliding contact with one side of the pin header contact pin 122. This can cause the second arm 174 to deflect about its flexure line 178 independently of the first arm 172. Due to the spaced apart relation between the first and second arms 172, 174, the pin 122 can move adjacent to the longer second arm 174 and through the recess 190 defined by the second arm. As the wafer 140 and pin header 108 are moved further into engagement, the raised contact protuberance 192 of the shorter first arm 172 will come into sliding contact with the respective pin 122. If necessary, the first arm 172 can also deflect generally about its flexure line 176. Accordingly, two points of redundant contact along a single line of action are established between each respective bifurcated contact 164 and header pin 122.

Figure 8:
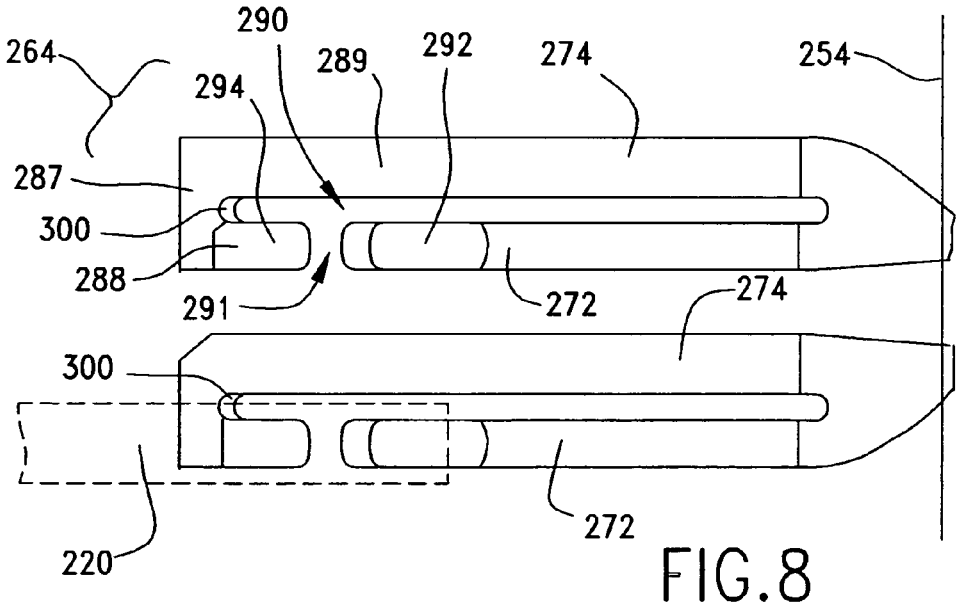
FIG. 8 is a detailed view illustrating an alternative embodiment of a bifurcated contact having a first straight arm and a second "J" shaped arm; and, FIG. 9 is a plan sectional view taken facing the daughtercard connector, of the bifurcated contact ends and the contact pins in a mated condition and taken along lines 9-9 of FIG. 2.
Figure 9:
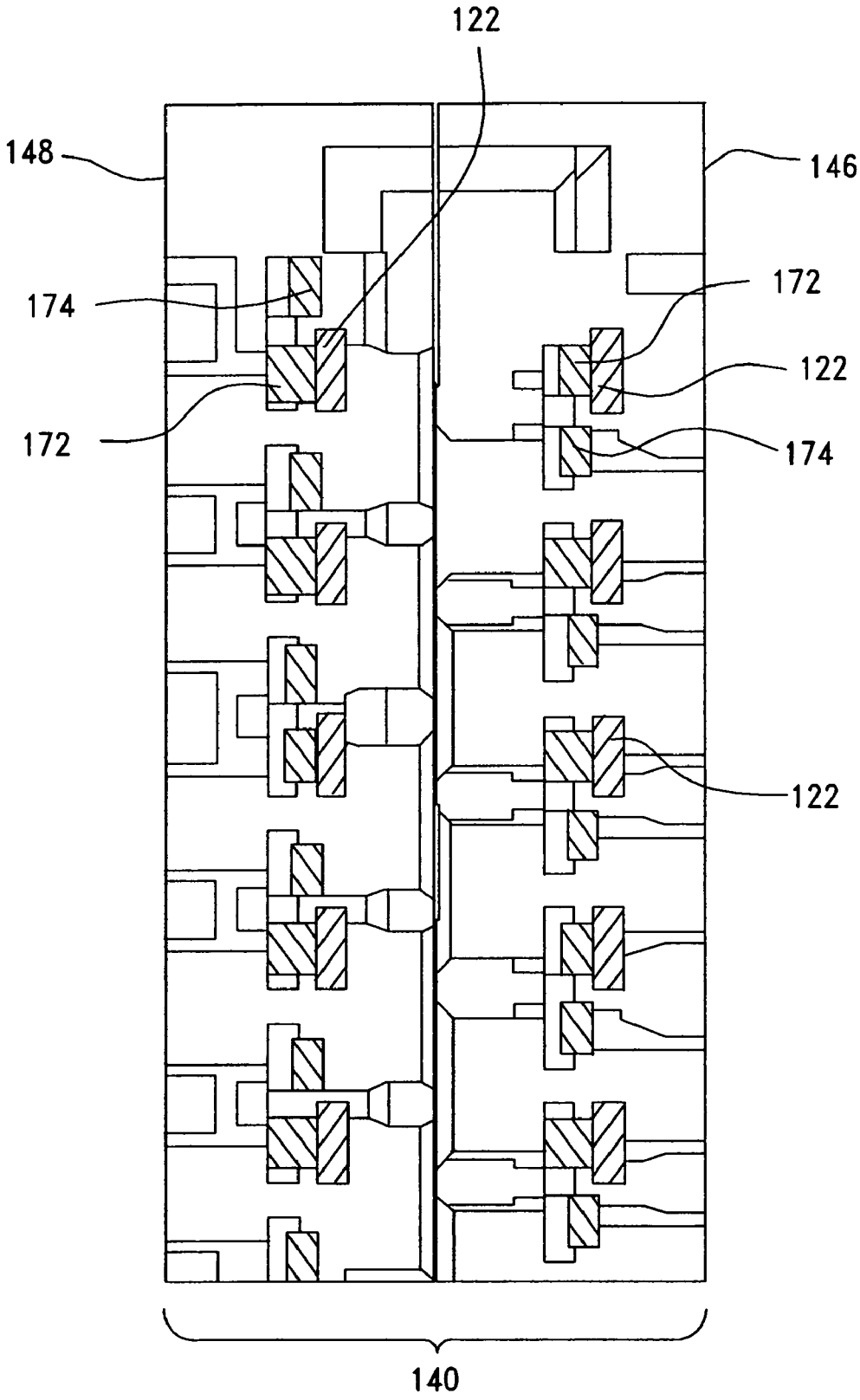

FIG. 8 illustrates another embodiment of a bifurcated contact 264 of the present invention in which a "J" shape contact is used. The bifurcated contact 264 again includes coplanar first and second arms 272, 274 that can generally extend in parallel, spaced apart relation. The first, shorter arm 272 can be substantially straight while the longer second arm 274 can be "J" shaped having a distal end that hooks back (or returns) toward the mating edge of the connector. Specifically, the "J" shaped second arm 274 can have, as shown, a first leg 287 that extends transversely from the distal end of the main linear portion 289 of the second arm. For ease in forming the contact portion at the end thereof, the second arm 274 is preferably provided with a slot, or notch, 300 located at its contact end in the first leg 287 and positioned between the second arm and the second leg. This permits the contact head 294 to be more easily formed. Extending from the first leg 287 is a second leg 288 which can be directed back toward the mating face 254 of the wafer and parallel to, but offset from the main linear portion 289 so as to provide the "J" shape. Moreover, the second leg 288 can be linearly aligned with the first arm 272 and is separated therefrom by a slight gap 291. Further, the second leg 288 preferably can have approximately the same width of the first arm. The "J" shaped second leg 274 outlines a recess 290 in which the shorter first leg 272 can be disposed. FIG. 9 is a plan sectional view taken along lines 9-9 of FIG. 2 that illustrates how the contacts of the daughter card connector make contact with the pins of the backplane connector.

The second embodiment of the bifurcated arm 264 may also have first and second raised contact protuberances 292, 294. The first contact protuberance 292 can be formed on the distal end of the first straight arm 272 while the second contact protuberance 294 can be formed on the second leg 290 of the second "J" shaped arm 274. According, the second contract protuberance 294 is positioned further from the mating edge 254 than the first contact protuberance 292. Because the first arm 272 and the second leg 288 of the linearly aligned, the first and second contact protuberances 292, 294 are likewise linearly aligned. As can be appreciated, when the bifurcated contact 264 is aligned and moved into contact with a contact pin 220, the pin 220 will first come into sliding contact with the second protuberance 294 and then come into sliding contact with the first protuberance 292.

To facilitate high speed data transmission in the illustrated embodiment, the backplane connector can be configured to carry differential signals. As will be familiar to those of skill in the art, differential signals are transmitted by designating a first contact or conductive path to carry an electrically positive signal and designating an adjacent second contact or conductive path to carry an electrically negative signal. Because the first and second contacts are physically adjacent to each other, they can electrically couple together and thereby preserve the signal integrity of the connector. Though utilizing differential signals requires two individual contact leads to carry signals, it remains desirable to minimize the size of the daughter card connector.

Referring to FIG. 5, to realize differential signaling, conductive leads 160 can be designated as differential signal contacts 200 or as ground contacts or ground shields 210. Each signal lead 200 can include a relatively thin conductive portion 170 that extends between the compliant terminal 162 and the bifurcated contact 164. The conductive portion 170 extends or forms the 90° bend so that the compliant pin terminals 162 and the bifurcated contacts 164 are arranged perpendicularly to each other. The differential signal leads 200 are arranged in adjacent pairs 202 such that the conductive portion 170 of each differential signal contact of the pair are generally edge coupled to each other. As can be appreciated, coupling occurs when a pair of leads carrying differential electrical signals are spaced so closely together that electricmagnetic and radio frequency interference from one lead is absorbed by the adjacent lead.

To isolate the differential signal pairs 202 from each other, leads which make up the ground shields 210 are located in between the differential pairs. The ground shield lead 210 can also include a wider conductive portion 171 that extends between the compliant terminal 162 and bifurcated contacts 164. The conductive portions 171 of the ground shield leads can also extend or form a 90° bend so that they generally follow the conductive portions of the differential signal leads 200 and so that the respective complaint terminals 162 and the bifurcated contacts 164 are arranged perpendicularly to each other. The conductive portions 170 of the ground leads 210 are relatively wider than the conductive portion of the signal contacts 200.

Because ground shield leads 210 are co-planar with the signal leads 200 within the lead frame 166, it will be appreciated that each ground shield lead can edge couple with an adjacent signal lead. Moreover, within each wafer, the alternating arrangement between the differential signal pairs and ground shield leads in one waflet can be opposite or reversed in an opposing waflet. Accordingly, the wider ground shield lead 210 in one waflet will oppose a differential signal pair 202 in an opposite waflet, thereby causing the differential signal pairs in one waflet to broadside couple with a ground shield lead in an opposing waflet. The staggered array of ground shield leads throughout the wafer enables the ground shields to cooperatively act as a single, or "pseudo" ground shield in each wafer. In this context, broad side coupling refers to electrical coupling of leads which are arranged to oppose each other along their broader widths in contrast as to along their narrower edges. As can be appreciated, this further isolates and thereby minimizes cross-talk between differential signal pairs in the connector.

All references, including publications, patent applications, and patents, cited herein are hereby incorporated by reference to the same extent as if each reference were individually and specifically indicated to be incorporated by reference and were set forth in its entirety herein.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An electrical connector assembly comprising:

a pin header adapted to be mounted to a backplane board, said pin header including an insulative body and a plurality of conductive pins retained in and projecting from said insulative body, said plurality of pins arranged in rows and columns, each of the plurality of pins having a first side facing a first direction; and a daughter card connector mateable with said pin header, said daughter card connector including a mating face and a plurality of conductive leads extending through said daughter card connector, said contact leads including first and second arms extending in parallel relation to each other, said second arm having an "L" shaped terminal end with a portion extending transversely to the first arm, the first arm having a first contact protuberance and the second arm having a second contact protuberance, the first and second contact protuberance configured to engage the first side of the pins in the pin header.

2. The electrical connector of claim 1, in which said first arm extends a first distance from the mating face and said second arm extends a second distance from the mating face, said first distance being less than said second distance.

3. The electrical connector of claim 2, in which said first arm includes a first contact protuberance and said second contact arm includes a second contact protuberance, the second contact protuberance being spaced apart from said second contact arm and linearly aligned with the first contact protuberance.

4. The electrical connector of claim 1, in which said daughter card connector is comprised of a plurality of wafers, each wafer retaining a plurality of said adjacent conductive leads.

5. The electrical connector of claim 4, in which said conductive leads are formed from a conductive sheet material.

6. The electrical connector of claim 1, in which said plurality of conductive leads includes at least one ground contact lead and at least one differential signal pair of contact leads.

7. The connector of claim 1, wherein the plurality of conductive leads comprises first contact leads and second contact leads, the first contact leads extending a different distance than the second contact leads, wherein the contact protuberances are configured to provide at least three different points of engagement with the pins in the pin header.

8. A stamped lead frame of conductive material comprising:

a plurality of conductive leads, each said conductive lead having a complaint terminal at a first end, a bifurcated contact at a second end, and a conductive portion extending between the complaint terminal and the bifurcated contact, said conductive leads being arranged in a co-planar, parallel and spaced relationship;

said bifurcated contact includes a first cantilevered arm with a first contact protuberance and a second cantilevered "L" shaped arm with a second contact protuberance, said first cantilevered arm and a main linear extension of said second "L" shaped arm being joined to and extending from the conductive portion in a co-planar, spaced apart relation and the first and second contact protuberances being configured to engage a mating pin on a first side.

9. The stamped lead frame of claim 8, in which said first arm has a first length and said second arm has a second length greater than said first length.

10. The stamped lead frame of claim 9, in which said second "L" shaped arm extends back toward said first cantilevered arm in the configuration of a hook, but is spaced apart from said first cantilevered arm.

11. An electrical connector comprising:

a plurality of conductive leads adjacently arranged in at least one or more columns, said leads each including a bifurcated contact extending generally perpendicularly through a mating face of the connector, said bifurcated contacts each including a first arm extending from the mating face a first distance and having a first contact protuberance and a second arm extending from the mating face a second distance longer than the first distance and having a second contact protuberance, said first and second arms being co-planar to an imaginary plane oriented normal to the mating face, said first contact arm being disposed in a recess delineated by said second contact arm and configured to sequentially engage a first side of a mating pin with the first contact protuberance and the second contact protuberance.

12. The electrical connector of claim 11, in which the distal end of said first arm includes a first contact protrusion and the distal end of said second arm includes a second contact, said first and second contact protrusions linearly aligned along an imaginary line oriented normal to the mating face.

13. The electrical connector of claim 12, further comprising at least one wafer, said wafer including an insulative support frame, said columns of conductive leads being disposed in said insulative support frame.

14. The electrical connector of claim 13, in which said wafer includes a first side and an opposing second side, the mating edge extending orthogonally between said first and second sides.

15. The electrical connector of claim 14, in which said first and second contact protuberances are directed toward the first side of said wafer.

* * * * *